109-16 SR
10/16/79 OR 4,170,947

United States Patent [19]

Morgan

[11] 4,170,947

[45] Oct. 16, 1979

[54] SECURITY WINDOW

[76] Inventor: Laurence G. Morgan, The Gables, Rosemary La., Thorpe, Egham, Surrey, England

[21] Appl. No.: 867,667

[22] Filed: Jan. 9, 1978

[30] Foreign Application Priority Data

Jan. 27, 1977 [GB] United Kingdom ..... 3324/77

[51] Int. Cl.[2] ..... E05G 7/00

[52] U.S. Cl. ..... 109/16; 109/19; 109/21; 109/21.5; 350/285; 350/301

[58] Field of Search ..... 109/10, 11, 15, 16, 109/19, 21, 21.5; 350/285, 299, 301

[56] References Cited

U.S. PATENT DOCUMENTS

| | | | |
|---|---|---|---|
| 1,747,928 | 2/1930 | Chesney | 350/301 X |
| 1,834,036 | 12/1931 | Simpson | 109/16 X |
| 3,041,916 | 7/1962 | Clavé et al. | 350/301 X |
| 3,067,700 | 12/1962 | O'Meara et al. | 109/21 X |
| 4,005,662 | 2/1977 | Kohn et al. | 109/16 |

FOREIGN PATENT DOCUMENTS

| | | | |
|---|---|---|---|
| 2103357 | 8/1972 | Fed. Rep. of Germany | 109/21.5 |
| 866233 | 7/1941 | France | 109/21.5 |

*Primary Examiner*—Mervin Stein
*Assistant Examiner*—David H. Corbin
*Attorney, Agent, or Firm*—Brown, Flick & Peckham

[57] ABSTRACT

A security window has a non-transparent bullet resistant screen between the people on either side of the window. Because this screen cannot be seen through, an arrangement of mirrors (two on each side of the screen) is provided to reflect images from each side across to the other side. The customer and cashier each look into mirrors set at eye level on their respective sides of the screen and reflected images are directed to a point above the screen where two mirrors are arranged in a cavity. This cavity tends to act as a sounding box and permits sound to travel from one side of the screen to the other. The eye-level mirror on the cashier's side can be moved to a position where it merely reflects back the image reflected from the other side, in the event of an attack.

1 Claim, 3 Drawing Figures

SECURITY WINDOW

This invention relates to a security window for bank counters or the like, having a bullet-resistant screen disposed between the cashier and the customer.

The window is suitable for installation at a counter or office enclosure in a bank or other establishment where money and/or valuables are to be transferred across a counter or between persons on opposite sides of a partition or wall.

At the present time, most banks and similar establishments have a plasticized glass screen between the cashier and the customer. These screens are alternatively known as "percussion proof," or "bandit proof," but they are not bullet proof.

Bullet proof glass is known, and is used in high-risk situations. However, bullet proof glass is extremely expensive.

A problem which is common to both these types of glass screen is that of audio communication between the two sides. With bullet proof screens, it is necessary to have an electrical communication system with a microphone on each side. This is expensive, and can be unsatisfactory in that customers do not always speak directly into the microphone as they should. With plasticized glass, slots are often provided in the screen. The provision of these slots means that the sound between the two sides does not travel directly, and so is somewhat muted. In addition, these slots constitute a break in the defences offered by the screen.

An object of the present invention is to provide a security window which is relatively cheap to make, it resistant to bullets, and provides good audio communication between the two sides of the window.

In order to achieve this object, the invention provides that the screen is opaque and that four mirrors are arranged with one mirror on each side of the screen for cashier and customer respectively to look into, and the other two mirrors arranged beyond one edge of the screen to project images between the mirrors on each side of the screen.

With this arrangement, a non-reversed upright image of the cashier may be viewed by the customer, and vice versa. It has surprisingly been found that sound is very effectively transmitted between the two sides of the screen.

The window may be set on top of a counter or inserted into a screen partition or wall, with the opaque screen arranged in a vertical plane. Preferably, the other two mirrors are arranged above the screen within a cavity formed in a partition above the screen. These mirrors are preferably arranged at right angles to one another and each inclined at approximately 45° to the opaque screen.

The mirrors on each side of the screen may then also be arranged at approximately 45° to the screen, but that on the side of the cashier is preferably adjustable in inclination so as to suit the individual heights of the cashier and customer.

A small recess may be provided in the top of a counter beneath the screen in order to allow money or valuables to be passed between the cashier and the customer. For this purpose, a conventional turn-table arrangement or sliding cover may for example be incorporated in the recess which is suitably protected from bullet penetration, e.g. by incorporating sheet steel claddings in the faces of the recess.

Furthermore, the adjustable mirror may be arranged so as to be able to rotate to a near horizontal position, so that in the event of an assault the assailant will then see a reflection of himself, the mirror in this position at the same time being arranged to actuate an alarm bell.

The opaque bullet-resistant screen may for example be made of steel of suitable thickness, with appropriate cladding such as wood to absorb projectiles and for the sake of appearance. Such a screen will be more secure and cheaper to produce than a bullet-resistant glass screen.

An example of the invention is shown in the accompanying drawings, in which.

Figure 1:
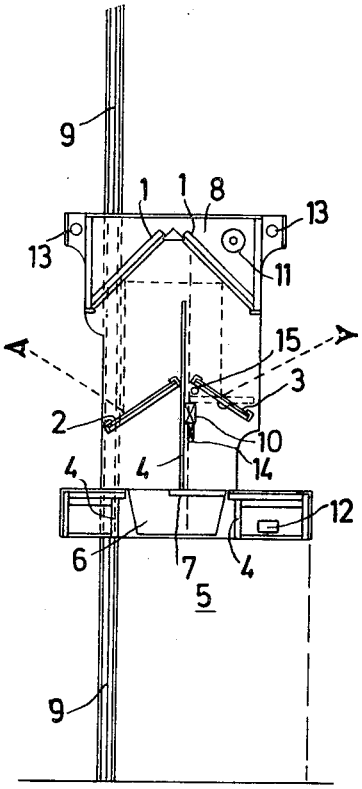
FIG. 1 is a sectional view of a bank counter incorporating a security window.

As shown in the drawings, two fixed mirrors 1 arranged at right angles to one another and at approximately 45° to the vertical project images between a fixed mirror 2 and an adjustable mirror 3 arranged respectively on each side of an opaque bullet-resistant screen 4 disposed in a vertical plane above a counter 5. A recess 6 with a sliding cover 7 is incorporated in the top of the counter 5 below the screen 4 in order to allow money or valuables to be passed between a customer on the left-hand side in the drawings and a clerk on the right hand side, and vice versa, the cover 7 at the same time preventing a weapon from being pointed through the recess 6.

The mirrors 1 are arranged in a cavity 8 above the screen 4, and the entire window is set into an appropriate aperture in a bullet resistant partition 9. It will be observed that there is no path by which a bullet may travel directly from one side of the counter to the other, the partition 9 preferably extending into the ceiling above and incorporating protected ventilation arrangements.

Figure 3:
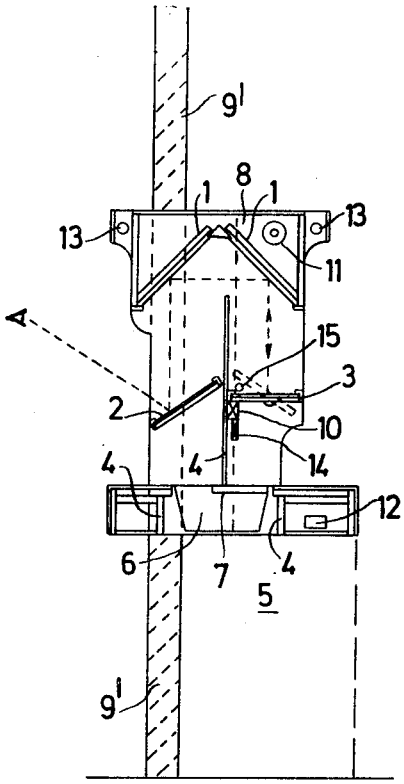
FIG. 3 is a sectional view of a security window built into a brick wall.
Figure 2:
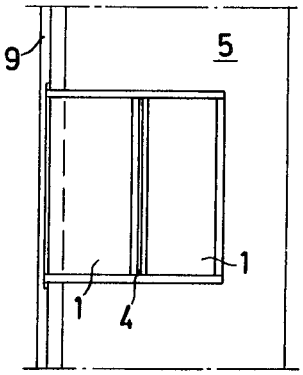
FIG. 2 is a plan view of the counter and window.

The opaque bullet-resistant screen 4 and partition 9 may for example be made of 10 gauge steel sandwiched between two layers of 18 mm thick plywood. Alternatively, as shown in FIG. 3, the security window may be built into a brick wall 9' or other partition.

In the event of an assault, the clerk may rotate the adjustable mirror 3 to a horizontal position (see FIG. 3) so that the assailant is presented with a reflection of himself. Furthermore, a switch 10 may be incorporated in the window in circuit with an alarm bell 11 and a battery 12, so that when the mirror 3 is rotated to the horizontal position, the bell will start ringing. Use of the battery will ensure operation of the bell even in the event of mains electricity in the establishment being cut off.

The security window may also include lighting 13 on each side to illuminate the clerk and customer, with an operating switch 14. Also, a ball catch safety retainer 15 may be incorporated in a side wall of the window to prevent inadvertent rotation of the mirror 3 to its alarm-raising horizontal position.

I claim:

1. A security window mounted in an opening in a partition separating an area of general access from an area where money or other valuables are stored, the window comprising an upright opaque bullet-resistant screen disposed in said opening between said areas and having an exposed edge, a first mirror on the storage side of the screen and a second mirror on the other side of the screen for persons on respective sides of the screen to look into, said mirrors normally being inclined at approximately 45° to the screen, the partition being provided with a cavity facing the exposed edge of the screen, third and fourth mirrors mounted in said cavity beyond said exposed edge of the screen at right angles to each other and inclined at approximately 45° to the opaque screen so as to project images across said edge between the first and second mirrors, the first mirror being adjustable in inclination relative to said screen, an alarm, an alarm switch connected with said alarm and positioned for activation by said first mirror to operate the alarm when the first mirror is tilted away from its said normal position, the window also including a recess beneath said screen for the transmission of valuables from one side of the screen to the other side.

* * * * *